US005690367A

United States Patent [19]

Fromer

[11] Patent Number: 5,690,367

[45] Date of Patent: Nov. 25, 1997

[54] LOTTERY CARD AND METHOD

[76] Inventor: Shmuel Fromer, 10 Reiness St., Kiryat Shmuel, Haifa, Israel

[21] Appl. No.: 620,271

[22] Filed: Mar. 22, 1996

[30] Foreign Application Priority Data

Mar. 26, 1995 [IL] Israel ..... 113126

[51] Int. Cl.[6] ..... B42D 15/00

[52] U.S. Cl. ..... 283/94; 283/903; 283/100; 283/111

[58] Field of Search ..... 283/903, 111, 283/100, 94; 273/148 R

[56] References Cited

U.S. PATENT DOCUMENTS

| | | | |
|---|---|---|---|
| 3,473,807 | 10/1969 | Leonard | 283/94 X |
| 4,241,943 | 12/1980 | Malinovitz | 283/94 X |
| 4,962,950 | 10/1990 | Champion | 283/94 X |
| 4,964,642 | 10/1990 | Kamille | 283/100 X |
| 5,002,313 | 3/1991 | Salvatory | 283/903 X |
| 5,046,737 | 9/1991 | Fienberg | 283/903 X |
| 5,407,200 | 4/1995 | Zalabak | 283/903 X |
| 5,411,260 | 5/1995 | Smith | 283/903 X |
| 5,451,052 | 9/1995 | Behm et al. | 283/901 X |
| 5,494,317 | 2/1996 | Johnson | 283/100 X |
| 5,542,710 | 8/1996 | Silverschotz et al. | 283/94 |

FOREIGN PATENT DOCUMENTS

| | | | |
|---|---|---|---|
| 1555462 | 11/1979 | United Kingdom | 283/903 |
| 2075918 | 11/1981 | United Kingdom | 283/903 |

*Primary Examiner*—Daniel W. Howell
*Assistant Examiner*—Julie A. Krolikowski
*Attorney, Agent, or Firm*—Ostrolenk, Faber, Gerb & Soffen, LLP

[57] ABSTRACT

A lottery card comprising a given number of fields, arranged in a successive order. Each field is divided into a given number of frames. At least one of the frames of every field contains a mark. All marks are related to each other according to a successive order, and are concealed by being coated with a removable coating.

4 Claims, 2 Drawing Sheets

LOTTERY CARD AND METHOD

BACKGROUND OF THE INVENTION

The present invention relates to lotteries, and more particularly to a novel lottery card or ticket, and a method of processing same.

Conventional lottery cards are, as a rule, adapted to one-time use in the sense that every card participates in a single lottery. Either it wins or it loses.

The object of the invention is to provide a progressively winning lottery card, namely which is based on the natural tendency and impulse of the common gambler to increase the winning amounts by re-playing with previous winning funds, in spite of the fact that the winning chances grow less and less as the winning amounts increase.

SUMMARY OF THE INVENTION

Thus provided is a lottery card comprising a given number of fields, arranged in a successive order. Each field is divided into a given number of frames. At least one of the frames of every field contains a mark. All marks are related to each other according to a successive order, and are concealed invisible by being coated with a removable coating.

The marks may be digits arranged in the numeric rising scale order.

The digits may be of a predetermining group wherein every field contains one or more of the digits of the group. Alternatively, the marks may be letters of a given word, namely having an internal successive order dictated by the word.

BRIEF DESCRIPTION OF THE DRAWINGS

The invention will be more clearly understood in the light of the examples described below in conjunction with the attached drawings, wherein.

DETAILED DESCRIPTION OF A PREFERRED EMBODIMENT

Figure 1:
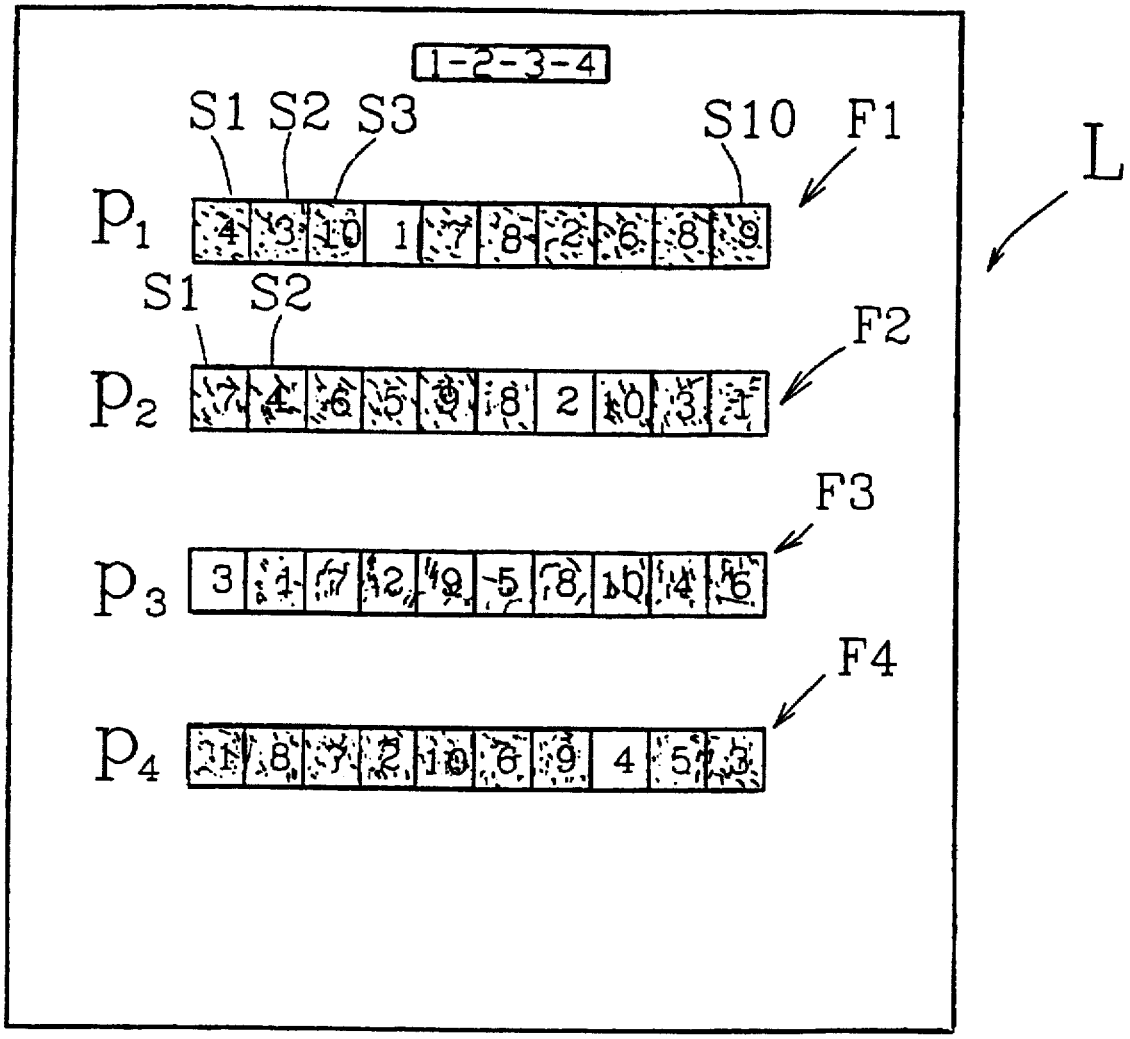
FIG. 1 represents a first, numeric embodiment of a lottery card featuring the principles of the present invention.

Referring to FIG. 1, there are shown a lottery card or ticket L, containing four rows arranged one below the other, representing fields designated F1, F2, F3 and F4; of course the number of fields may vary according to the designer's option. The fields are subdivided into ten squares or frames, S1, S2, S3 , . . . , S10. Within every frame, a digit from 1 to 10 is imprinted, at a random order.

The imprinted numbers are concealed, being coated by a coating which is easily removable by scratching with a coin or a similar object, as known in other lottery or parking cards.

The same applies to fields F2, F3 and F4, it being understood that the random order of the digits differs from one field to the other.

P1, P2, P3 and P4 represent the respective winning amounts (see below). The lottery method takes place as follows. The player buys the lottery card L for a prescribed price. He must then start removing the coating on one of the frames S of the first field F1. If lucky—the first revealed number is "1", which will give the option to collect the first prize amount P1 (it being understood that the prize P1 is rather low, but of course exceeding the buying price of the card).

Alternatively, he can choose to go on to the second field F2 and remove the coating from anyone of its frames S. If the exposed number is anyone but the number 2—the player loses altogether and the card is exhausted. If, however, he exposes the next successive number, namely 2, the former option applies again, i.e., collecting the second prize P2, (which is higher than the prize P1), or proceeding to F3 with the aim to expose the number 3. This continues with respect to the remaining field F4 or any other successive field available on the card.

As each field in FIG. 1 has 10 frames; simple calculations will show that the chances of losing the initial card price increases by the factor of 10 each time a further field is approached.

Figure 2:
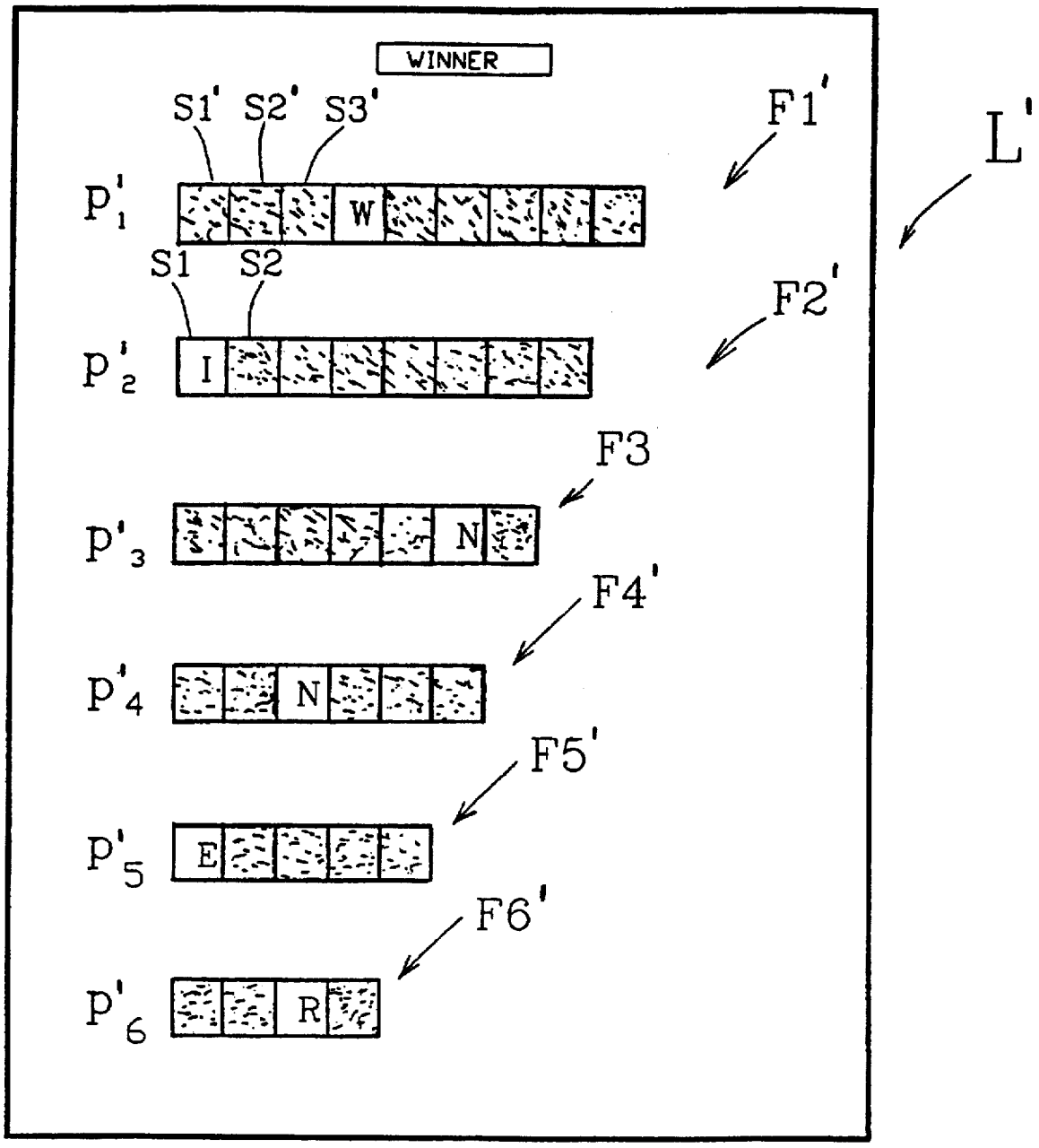
FIG. 2 illustrates another example of the invention.

In the example illustrated in FIG. 2, the numbers have been substituted by letters of a given word, say "WINNER". Again there are available a number of fields F1'–F6' in this case comprising a different number of frames S', in order to illustrate the versatility of the lottery method. Each field may contain blank frames with only one frame containing a letter of the password "WINNER". The method of playing this card is analogous to that of the former example and thus need not be described in greater detail.

Various changes and modifications of the lottery card, and the method of processing same, will be apparent.

What is claimed is:

1. A lottery card comprising:

a succession of marks in a given order, printed on the card;

a first plurality of fields, arranged in a successive order, each field being divided into a respective individual plurality of frames;

at least one and fewer than the entire individual plurality of the frames of the first field being imprinted with the first mark of the succession of marks;

at least one and fewer than the entire individual plurality of the frames of the second field being imprinted with the second mark of the succession of marks; and so forth through each of the first plurality of the fields;

all of the frames of all of the fields being effectively concealed by opaque coating material which can be irreversibly removed from individual frames by a user to reveal the marks imprinted under the coating at the individual frames;

an amount of a lottery prize associated with each of the marks, wherein the amount of the lottery prize increases progressively relative to the number of the marks revealed in the succession in the given order.

2. The lottery card as claimed in claim 1, wherein the marks are digits and the order is in a numeric rising scale order.

3. The lottery card as claimed in claim 2, wherein the digits are of a predetermined group, and every field contains all the digits of the group dispersed among the frames of the field.

4. The lottery card as claimed in claim 1 wherein the marks of the succession are letters.

* * * * *